United States Patent [19]

Brisson

[11] Patent Number: 4,994,686

[45] Date of Patent: Feb. 19, 1991

[54] AUDIO FREQUENCY CABLE WITH REDUCED HIGH FREQUENCY COMPONENTS

[76] Inventor: Bruce A. Brisson, 3037 Grass Valley Hwy., Auburn, Calif. 95603

[21] Appl. No.: 302,840

[22] Filed: Jan. 27, 1989

[51] Int. Cl.[5] ..... H01B 7/08; H01B 11/02

[52] U.S. Cl. ..... 307/147; 174/115; 333/202

[58] Field of Search ..... 174/115, 117 R, 117 F; 307/147, 148, 250; 333/167, 24 R, 26, 28 R, 22 R, 23, 246, 28 T, 140, 156, 160, 161, 162, 166, 202, 204, 206, 81 R, 81 A, 236, 237, 243–246; 381/94, 98

[56] References Cited

U.S. PATENT DOCUMENTS

| | | | |
|---|---|---|---|
| 2,196,272 | 4/1940 | Peterson | 333/202 |
| 2,637,781 | 5/1953 | Bohnert | 333/206 X |
| 4,204,129 | 5/1980 | Hutchins, Jr. | 307/147 |
| 4,718,100 | 1/1988 | Brisson | 381/77 |
| 4,734,544 | 3/1988 | Lee | 174/117 F |
| 4,777,325 | 10/1988 | Siwinski | 174/34 |

*Primary Examiner*—A. D. Pellinen
*Assistant Examiner*—David Osborn
*Attorney, Agent, or Firm*—Fliesler, Dubb, Meyer & Lovejoy

[57] ABSTRACT

Audio cabling includes a first conductor in conductive communication with the positive side of the source or of the load. It extends towards but terminates free of the load if it is connected to the source and free of the source if it is connected to the load. A second conductor has a first end in conductive communication with the negative side of the source or of the load. If it is connected to the source negative side it has a second end which extends towards but terminates free of the load. If it is connected to the load negative side it has a second end which extends toward but terminates free of the source. The conductors are separated from one another by a non-conductor. They are sufficiently long whereby they are in adjacent side by side relation at least along portions thereof. High frequency noise which can affect the ear's perception of audio frequency signals is reduced as are low frequency resonance effects.

30 Claims, 3 Drawing Sheets

AUDIO FREQUENCY CABLE WITH REDUCED HIGH FREQUENCY COMPONENTS

TECHNICAL FIELD

The invention relates to cabling for interconnecting audio components such as amplifiers and preamplifiers, amplifiers and speakers, microphones and preamplifiers, and the like.

BACKGROUND ART

The prior art primarily teaches the use of simple cables for interconnecting the positive side of a source, for example a microphone, a preamplifier, or an amplifier to the positive side of a load, for example a preamplifier, an amplifier or a speaker. Recently somewhat more complex audio cables have become available which correct for imperfections in the previous simple cables. One such cable is disclosed in U.S. Pat. No. 4,718,100, issued to Bruce A. Brisson on Jan. 5, 1988. The cable set forth in that patent addresses the problem of time misalignments between high frequency and low frequency sound components transmitted through the cable. To accomplish this a pair of open circuited conductors are utilized, one connected to either the source positive side or the source return side and the other connected to either the load positive side or the load negative side. The open circuited conductor attached to the source extends towards the load but terminates free of connection with the load. The open circuited conductor attached to the load extends towards but terminates free from connection with the source. A cable of this construction corrects for time misalignments between high frequency and low frequency sound components transmitted through the cable.

Another problem which exists with the cabling of the prior art is that as in any capacitive charges becomes capacitively stored in the dielectrics (insulator portions) of the cable adjacent the conductors. These charges are discharged through the dielectric at or following the zero crossings of the audio signal. The discharges take place in short time intervals leading to their being high frequency discharges. Gap discharging of this nature can occur between the insulation of the positive source to load connecting line and the insulation of the negative source to load connecting line. This leads to a very high megaHertz frequency distortion, beyond the audio frequency (20 Hz to 20,000 Hz) range, but which is both detectable and undesirable as it affects the shape and rise and fall times of the audio frequency signal and the listeners ear is sensitive to such phenomena. Also, this creates a sustained low frequency resonance, in the range from less than a Hertz up to a few hundred Hertz, on which the audio frequencies of interest are modulated and to which the listener's ear is directly responsive.

The present invention is directed to overcoming such problems as are set forth above.

DISCLOSURE OF INVENTION

In accordance with an embodiment of the present invention cabling is provided for interconnecting a source having a positive side and a negative side to a load having a positive side and a negative side. The cabling includes first source-load connecting means for electrically connecting the source positive side to the load positive side and second source-load connecting means aligned generally along the first source-load connecting means, for electrically connecting the source negative side to the load negative side. A first open circuited conductor has a first end in conductive communication with either the source positive side or the load positive side. The first open circuited conductor has a second end which extends towards and terminates free from connection to the load if the first end is connected to the source positive side and has a second end which extends towards and terminates free from connection to the source if the first end is connected to the load positive side. A second open circuited connector has a first end and a second end. The first end of the second open circuited conductor is in conductive communication with either the source negative side or the load negative side. The second end of the second open circuited conductor extends towards and terminates free from connection to the load if the first end is connected to the source negative side. The second end extends towards and terminates free from connection to the source if the first end is connected to the load negative side. The conductors are separated by a non-conductor. They are sufficiently long whereby they are in adjacent side by side relation at least along portions of the lengths thereof.

Cabling in accordance with the present invention significantly reduces very high frequency noise which deleteriously affects sound quality in the audio range.

BRIEF DESCRIPTION OF DRAWINGS

The invention will be better understood by reference to the figures of the drawings which form a part hereof and wherein like numbers denote like parts throughout and wherein.

BEST MODE FOR CARRYING OUT INVENTION

Figure 1:
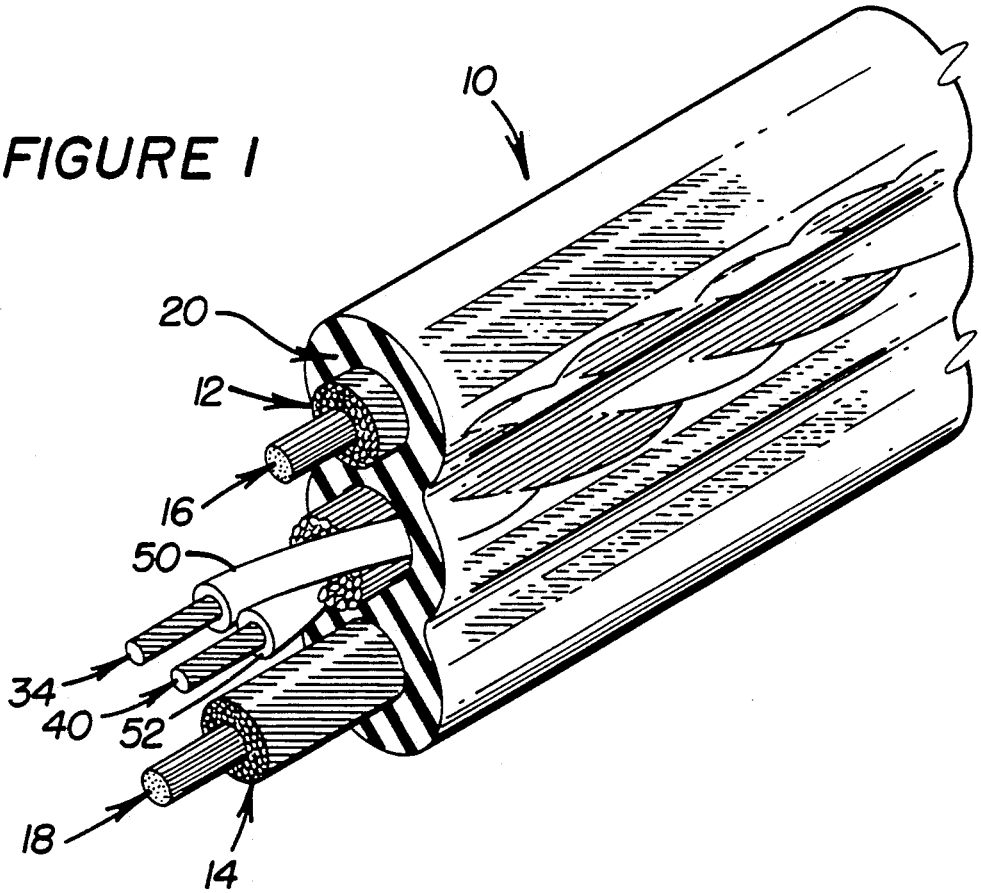
FIG. 1 is an isometric view, partially cut away, of a section of cable in accordance with an embodiment of the present invention.
Figure 2:
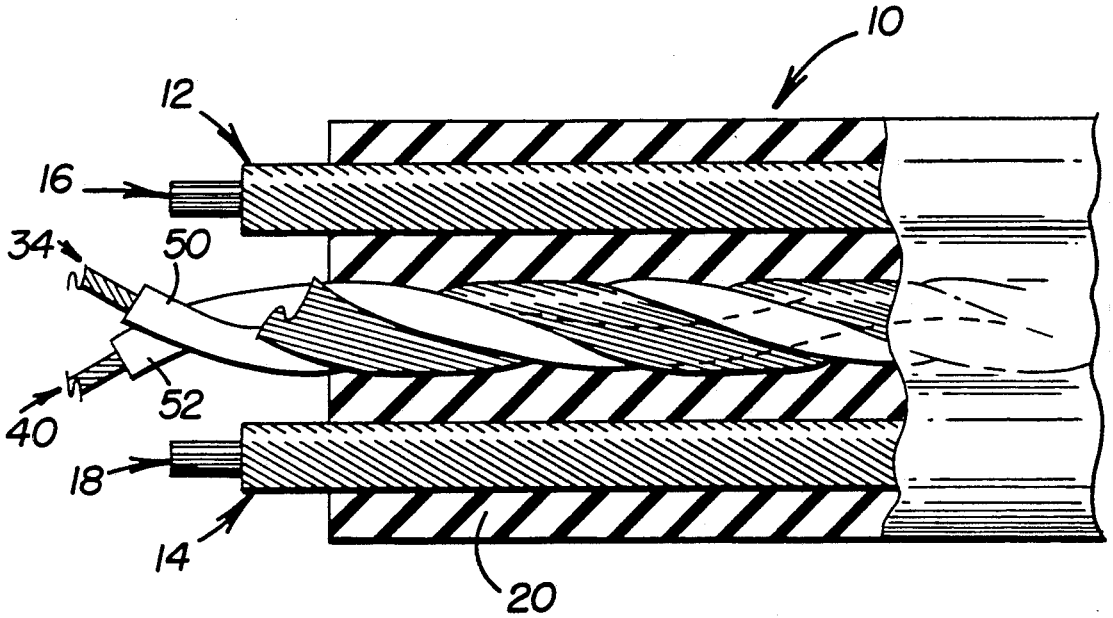
FIG. 2 is a side partial section view of the embodiment of FIG. 1.

FIGS. 1 and 2 illustrate one embodiment of cabling 10 in accordance with the present invention. The cabling includes first source-load connecting means 12 and second source-load connecting means 14 extending along the first source-load connecting means 12. In the embodiment illustrated in FIG. 1 source-load connecting means 12 and 14 are in the nature of a plurality or bundle of thin wires spirally wound about respective first and second insulator cores 16 and 18. The insulator cores 16 and 18 can be solid pieces but may themselves be bundles of thin insulator rods. Insulator material 20 serves for electrically isolating the first source-load conducting means 12 from the second source-load conducting means 14.

Figure 3:
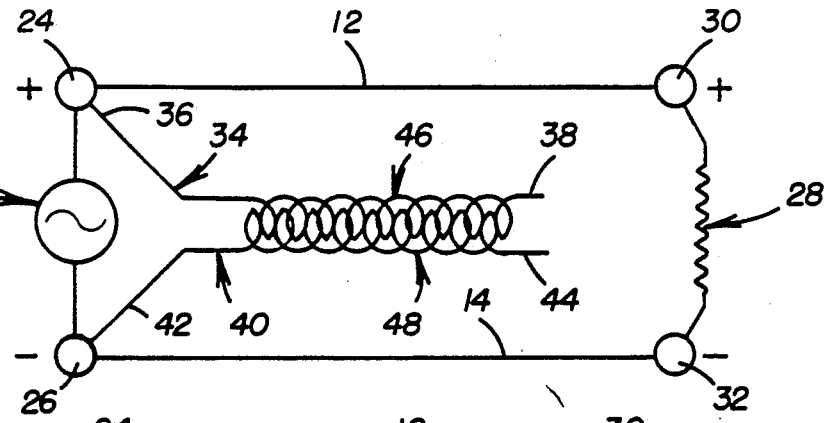
FIG. 3 illustrates, schematically, one circuit in accordance with an embodiment of the present invention.

Referring now to FIG. 3 it will be seen that the first source-load connecting means 12 and the second source-load connecting means 14 serve for connecting a source 22 having a positive side 24 and a negative side 26 to a load 28 having a positive side 30 and a negative side 32. More particularly, the first source-load connecting means 12 serves for electrically connecting the source positive side 24 to the load positive side 30. Also, the second source-load connecting means 14 extends along the first source-load connecting means 12 and serves for electrically connecting the source negative side 26 to the load negative side 32. Note that while the load is shown in the figures as being resistive it will also generally include inductive and sometimes capacitive elements, as well.

Figure 4:
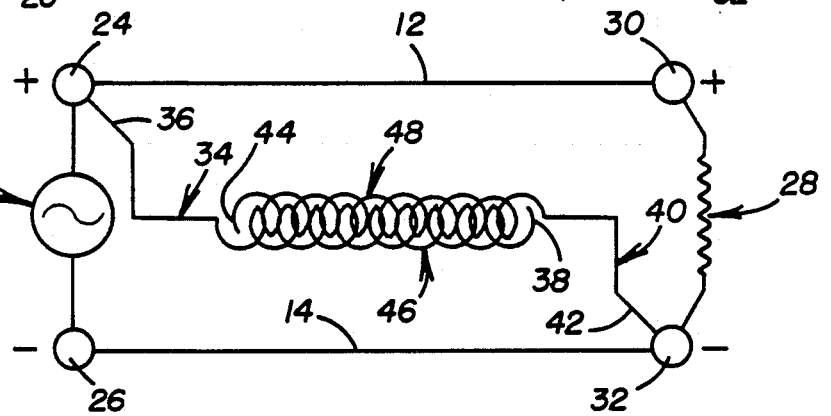
FIG. 4 illustrates, schematically, another circuit in accordance with an embodiment of the present invention.
Figure 5:
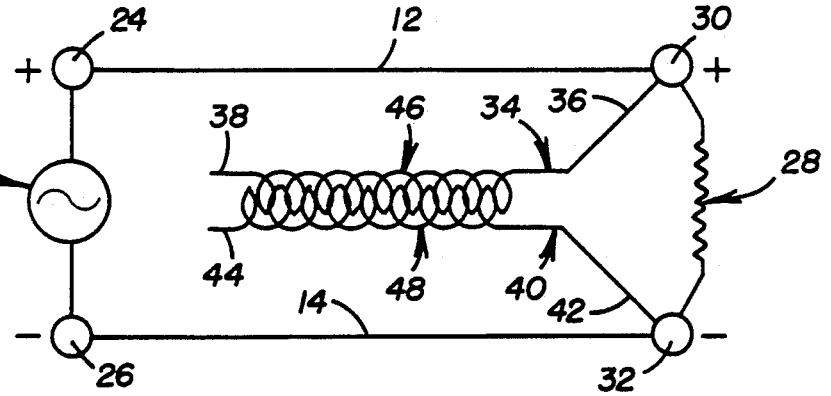
FIG. 5 illustrates, schematically, still another circuit in accordance with an embodiment of the present invention.
Figure 6:
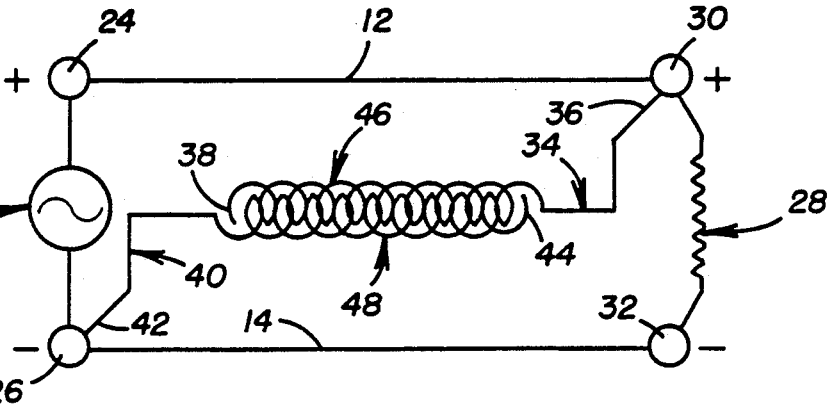
FIG. 6 illustrates, schematically, another circuit yet in accordance with an embodiment of the present invention.

In accordance with the present invention a first open circuited conductor 34 is present having a first end 36 and a second end 38. The first open circuited conductor 34, in the embodiment illustrated in FIG. 3 is connected to the source positive side 24. Again in FIG. 4 the first open circuited conductor 34 has a first end 36 in conductive communication with the source positive side 24. In the embodiments of FIGS. 5 and 6 the first open circuited conductor 34 has its first end 36 in conductive communication with the load positive side 30. Thus, in each instance the first open circuited conductor 34 is relatively positive. The second end 38 of the first open circuited conductor 34 extends towards and terminates free from connection to the load 28 in the embodiments of FIGS. 3 and 4, when the first end 36 of the first open circuited conductor 34 is in conductive communication with the source positive side 24. In the embodiments of FIGS. 5 and 6, when the first open circuited conductor 34 has its first end 36 in conductive communication with the load positive side 30, the second end 38 of the first open circuited conductor 34 extends towards and terminates free from connection to the source 22.

In the embodiments of FIGS. 3 and 6, and in accordance with the present invention, a second open circuited conductor 40 is present which has a first end 42 and a second end 44. In the embodiments of FIGS. 3 and 6 the first end 42 of the second open circuited conductor 40 is in conductive communication with the source negative side 26. In both of these embodiments the second end 44 of the second open circuited conductor 40 extends towards and terminates free from connection to the load 28. In the embodiments of FIGS. 4 and 5 the first end 42 of the second open circuited conductor 40 is in conductive communication with the load negative side 32. In these instances the second end 44 of the second open circuited conductor 40 extends towards and terminates free from connection to the source 22. Thus, the second open circuited conductor 40 is always in communication with the negative side of the source 22 or the negative side of the load 28.

It is important in accordance with the present invention that the first and second open circuited conductors 34 and 40 be separated by a non-conductor, for example the dielectric insulation 20 shown in FIGS. 1 and 2. It is also important with the present invention that the first and second open circuited conductors 34 and 40 be sufficiently long whereby they are in adjacent side by side relation at least along respective portions 46 and 48 of their lengths. The term side by side relation is used broadly herein to include parallel relation as well as the twisted relation shown in FIGS. 1–6. Such portions 46 and 48 are generally adjacent the respective second ends 38 and 44 thereof but can be nearer to the centers of the open circuited conductors 34 and 40. It is preferred that along the portions 46 and 48 the first and second open circuited conductors 34 and 40 be closer together than are the source-load connecting means 12 and 14. It is preferable that the portions 46 and 48 of the lengths of the first and second open circuited conductors 34 and 40 which are in side by side relation extend substantially the entire length of the first and second source-load connecting means 12 and 14. The dielectric material used and the separations between the open circuited conductors 34 and 40 are chosen such that, at the voltages present, gap discharge occurs between the open circuited conductors 34 and 40 preferentially to between the source-load connecting means 12 and 14. Note in this regard that the voltage difference between the open circuited conductors 34 and 40 exceeds that between the source-load connecting means 12 and 14 due to the standing wave in the former.

The embodiment illustrated in FIG. 3, wherein the first open circuited conductor 34 is in conductive communication with the source positive side 24 and wherein the second open circuited conductor 40 is in conductive communication with the source negative side 26, and wherein the second ends 38 and 44 extend toward and terminate free from connection to the load 28 is the preferred embodiment of the present invention since the resulting capacitive action between the first open circuited conductor 34 and the second open circuited conductor 40 occurs in this embodiment right at the source whereby the circuit operates most efficiently. It is also easier when constructing the cabling 10 to have both the first open circuited conductor 34 and the second open circuited conductor 40 connected in conductive communication with a single side of the cable 10.

Referring again to FIGS. 1 and 2, one preferred geometry is illustrated. In this geometry the first and second open circuited conductors 34 and 40 are positioned along and between the first and second source-load connecting means 12 and 14. This assures that the first and second source-load connecting means 12 and 14 are quite far apart whereby any chances of gap discharge between them are essentially eliminated. Also in accordance with the embodiments of FIGS. 1 and 2 the portions 46 and 48 of the lengths of the first and second open circuited conductors 34 and 40 are twisted about one another whereby the first and second open circuited conductors 34 and 40 are quite long thereby providing relatively large capacitance and are quite close together, suitably closer together than are the open circuited conductors 34 and 40, to allow easy gap discharging therebetween, again serving to provide further protection against gap discharging between the first and second source-load connecting means 12 and 14.

Figure 7:
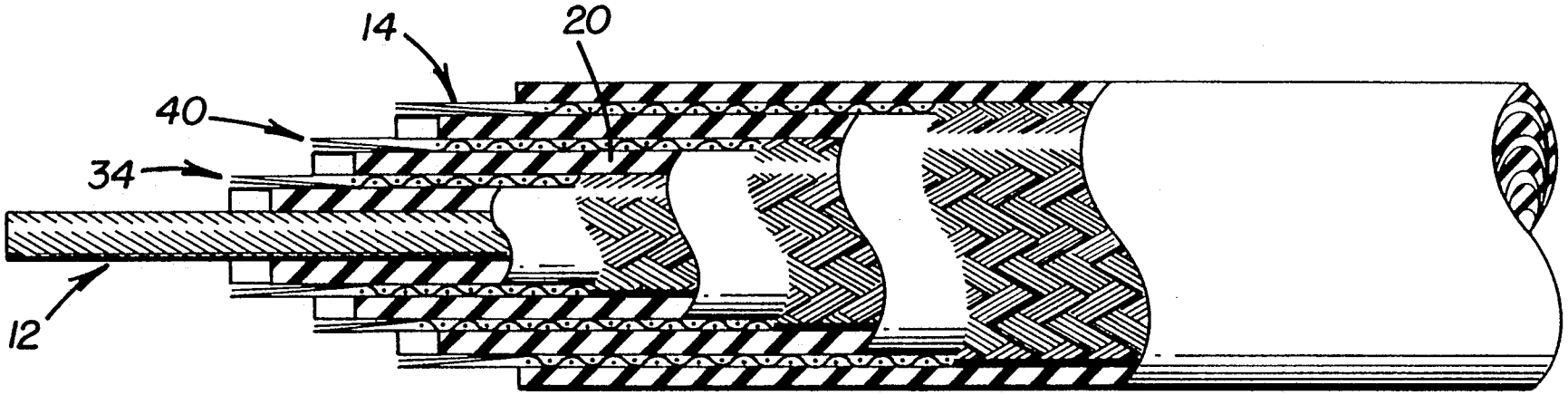
FIG. 7 illustrates, in side section view, partially cut away, a coaxial cable in accordance with an embodiment of the present invention.

FIG. 7 illustrates a coaxial embodiment of the present invention. In this embodiment the first source-load connecting means 12 is in the nature of a center conductor in a coaxial cable and the second source-load connecting means 14 is in the nature of a shield about the first source-load connecting means 12. Appropriate dielectric insulation 20 is present as with the embodiment of FIGS. 1 and 2. The first and second open circuited conductors 34 and 40 are similar in construction to the second source-load connecting means 14 in that they surround the first source-load connecting means 12. The first and second open circuited conductors 34 and 40 are located between the first and second source-load connecting means 12 and 14. For ease of construction the first open circuited conductor 34 will generally be nearer the first source-load connecting means 12 and the second open circuited conductor 40 will generally be nearer the second source-load connecting means 14. However, such is not essential. In this structure the advantage of coaxial shielding is provided.

It should be noted that the first and second open circuited conductors 34 and 40 of FIGS. 1 and 2 are shielded from one another as by the sheaths 50 and 52. In this manner a capacitive component is added and shorting between the positive and negative sides of the circuit is prevented.

INDUSTRIAL APPLICABILITY

In accordance with the present invention cabling 10 is provided for interconnecting a source 22 such as a microphone, a preamplifier or an amplifier to a load 28 such as a preamplifier, an amplifier or a speaker. Very high frequency noise which can affect the perception of music in the audio frequency range is greatly reduced. This is accomplished by use of a substantially purely capacitive component between the positive and negative sides of the circuit.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

I claim:

1. A cabling structure comprising:

first source-load connecting means for direct electrical connection of a source positive side to a load positive side for transmitting a broad band audio signal from said source positive side to said load positive side;

second source-load connecting means along the first source-load connecting means for direct electrical connection of a source negative side to a load negative side for transmitting a broad band audio signal from said source negative side to said load negative side;

a first open circulated conductor having a first end in conductive communication with a selected one of the source positive side and the load positive side and having a second end extending towards and terminating free from connection to the load if the first end is connected to the source positive side and to the source if the first end is connected to the load positive side;

a second open circulated conductor having a first end in conductive communication with a respective one of the source negative side and the load negative side and having a second end extending towards and terminating free from connection to the load if the first end is connected to the source negative side and to the source if the first end is connected to the load negative side; and said first and second open circulated conductors being separated by a non-conductor and being sufficiently long whereby they are in adjacent side by side relation at least along portions of the lengths thereof.

2. A cabling structure as set forth in claim 1, wherein said portions are closer together than are said source-load connecting means.

3. A cabling structure as set forth in claim 2, wherein said portions of said lengths of said first and second open circulated conductors are positioned along and between said first and second source-load connecting means.

4. A cabling structure as set forth in claim 3, wherein said second ends of said first and second open circulated conductors extend substantially the entire length of said first and second source-load connecting means.

5. A cabling structure as set forth in claim 4, wherein said portions of said lengths of said first and second open circulated conductors are twisted about one another.

6. A cabling structure as set forth in claim 5, wherein said portions are adjacent said respective second ends.

7. A cabling structure as set forth in claim 1, wherein said portions are adjacent said respective second ends.

8. A cabling structure as set forth in claim 1, wherein said first open circulated conductor is adapted to be connected in conductive communication with said source positive side, said second open circuited conductor is adapted to be connected in conductive communication with said source negative side, and said second ends each are adapted to extend towards and terminate free from connection to said load.

9. A cabling structure as set forth in claim 8, wherein said portions of said lengths of said first and second open circuited conductors are positioned along and between said first and second source-load connecting means.

10. A cabling structure as set forth in claim 9, wherein said second ends of said first and second open circuited conductors extend substantially the entire length of said first and second source-load connecting means.

11. A cabling structure as set forth in claim 10, wherein said portions of said lengths of said first and second open circuited conductors are twisted about one another.

12. A cabling structure as set forth in claim 11, wherein said first and second source-load connecting means each comprise a plurality of conducting strands about a non-conductive core.

13. A cabling structure as set forth in claim 1, wherein said portions of said lengths of said first and second open circuited conductors are positioned along and between said first and second source-load connecting means.

14. A cabling structure as set forth in claim 13, wherein said second ends of said first and second open circuited conductors extend substantially the entire length of said first and second source-load connecting means.

15. A cabling structure as set forth in claim 14 wherein said portions of said lengths of said first and second open circuited conductors are twisted about one another.

16. A cabling structure as set forth in claim 15 wherein said first and second source-load connecting means each comprise a plurality of conducting strands about a non-conductive core.

17. A cabling structure as set forth in claim 1, wherein said second ends of said first and second open circuited conductors extend substantially the entire length of said first and second source-load connecting means.

18. A cabling structure as set forth in claim 17, wherein said portions of said lengths of said first and second open circuited conductors are twisted about one another.

19. A cabling structure as set forth in claim 18, wherein said first and second source-load connecting means each comprise a plurality of conducting strands about a non-conductive core.

20. A cabling structure as set forth in claim 1, wherein said first and second open circuited conductors are positioned to preferentially undergo a gap discharge as compared to said first and second source-load connecting means.

21. A cabling structure as set forth in claim 1, wherein said first source-load connecting means and said second source-load connecting means each comprise a continuous wire.

22. A cabling structure as set forth in claim 1, wherein said broad band audio signal includes a zero crossing at each half cycle transition, and wherein:

said first and second open circulated conductors comprise a means for allowing gap discharge at each said zero crossing more readily than do said first and second connecting means, said means for allowing thus preventing gap discharge between said first and second connecting means to isolate said audio signal from high frequency distortion and low frequency modulation.

23. A cabling structure for transmitting electrical signals in the frequency range audible to humans, said cabling structure comprising:

first and second connecting means for coupling a positive side of a source to a positive side of a load and a negative side of said source to a negative side of said load, respectively, said first and second connecting means each including a source end and a load end;

first open circuit conductor means for coupling to said positive side of one of said source or said load;

second open circuit conductor means for coupling to said negative side of the other of said source or said load;

said first and second open circuit conductor means each including a first end and a second end;

substantially non-conductive insulating means for electrically insulating each given connecting means and open circuit conductor means from all other said connecting means and open circuit conductor means;

wherein at least three of said first and second connecting means and said first and second open circuit conductor means are tubular, and said first and second connecting means and said first and second open circuit conductor means are held within said insulating means in coaxial orientation.

24. The cabling structure of claim 23 wherein:

among said first and second connecting means and said first and second open circuit conductor means, one of said first and second connecting means is axially innermost, and the other of said first and second connecting means is axially outermost, said first and second open circuit conductor means lying between said first and second connecting means.

25. The cabling structure of claim 24 wherein:

said first end of said first open circuit conductor means is coupled to one of said source end and load end of one of said first and second connecting means;

said first end of said second open circuit conductor means is coupled to said one of said source end and load end of the other of said first and second connecting means; and said second ends of said first and second open circuit conductor means extend toward the other of said source end and load end of said first and second connecting means but are not coupled thereto.

26. The cabling structure of claim 25 wherein:

said one of said source end and load end is said source end.

27. The cabling structure of claim 25 wherein:

said one of said source end and load end is said load end.

28. The cabling structure of claim 24 wherein:

said first end of said first open circuit conductor means is coupled to one of said source end and load end of one of said first and second connecting means;

said first end of said second open circuit conductor means is coupled to the other of said source end and load end of the other of said first and second connecting means; and said second ends of said first and second open circuit conductor means extend past each other within said structure far enough to overlap each other.

29. The cabling structure of claim 28 wherein:

said one of said source end and load end is said source end.

30. The cabling structure of claim 28 wherein:

said one of said source end and load end is said load end.

* * * * *